US006973812B2

(12) United States Patent
Piermattei

(10) Patent No.: US 6,973,812 B2
(45) Date of Patent: Dec. 13, 2005

(54) ATTACHMENT DEVICE FOR KEYS AND OTHER ITEMS

(76) Inventor: David W. Piermattei, P.O. Box 350, Black Hawk, CO (US) 80422

( * ) Notice: Subject to any disclaimer, the term of this patent is extended or adjusted under 35 U.S.C. 154(b) by 0 days.

(21) Appl. No.: 09/802,852

(22) Filed: Mar. 9, 2001

(65) Prior Publication Data

US 2002/0124611 A1 Sep. 12, 2002

(51) Int. Cl.[7] ..... A45F 5/02

(52) U.S. Cl. ..... 70/456 R; 70/458; 70/459; 24/3.6

(58) Field of Search ..... 70/456 R, 457–459; 24/3.6, 3.13, 304, 265 CD; 2/244, 245, 235, 236; 224/163; D03/207, 208

(56) References Cited

U.S. PATENT DOCUMENTS

| | | | | | |
|---|---|---|---|---|---|
| 429,179 | A | * | 6/1890 | Shipman | 24/68 R |
| 437,550 | A | * | 9/1890 | Armentrout | 24/1 |
| 615,474 | A | * | 12/1898 | Brauch | 24/648 |
| 867,255 | A | * | 10/1907 | Dietz | 24/3.6 |
| 1,537,287 | A | * | 5/1925 | Bate | 24/3.13 |
| 1,552,156 | A | * | 9/1925 | Heller | 24/13 |
| 1,566,192 | A | * | 12/1925 | Forrest | 224/254 |
| 2,599,660 | A | * | 6/1952 | Poutinen | 24/3.6 |
| 2,975,497 | A | * | 3/1961 | Budreck | 24/303 |
| 3,041,697 | A | * | 7/1962 | Budreck | 24/303 |
| 3,574,901 | A | * | 4/1971 | Nogue | 24/304 |
| 3,711,341 | A | | 11/1973 | Laufer | 70/456 |
| 3,837,190 | A | * | 9/1974 | Monk | 70/456 R |
| 3,848,271 | A | * | 11/1974 | Goele | 2/338 |
| 3,906,763 | A | | 9/1975 | Bochory | 70/456 |
| 3,929,266 | A | * | 12/1975 | Kim | 224/255 |
| 3,979,934 | A | | 9/1976 | Isenmann | 70/459 |
| 4,004,325 | A | | 1/1977 | Hubachek | 24/3 |
| 4,072,033 | A | | 2/1978 | Eckerdt | 70/456 |
| 5,363,680 | A | * | 11/1994 | Wu | 206/37.6 |
| 5,667,441 | A | * | 9/1997 | Parsons | 463/47.7 |
| 5,778,495 | A | * | 7/1998 | Paugh | 224/242 |
| 5,860,191 | A | * | 1/1999 | Sieger | 24/13 |
| 6,026,515 | A | * | 2/2000 | Nielson et al. | 150/134 |
| 6,332,345 | B1 | * | 12/2001 | Huang | 206/37.1 |

FOREIGN PATENT DOCUMENTS

| | | | |
|---|---|---|---|
| GB | 2222360 | * | 7/1990 |
| WO | WO 91/11933 | * | 8/1991 |

* cited by examiner

*Primary Examiner*—Chuck Y. Mah
*Assistant Examiner*—Michael J Kyle
(74) *Attorney, Agent, or Firm*—Sheridan Ross P.C.

(57) ABSTRACT

An attachment device for attaching, e.g., a key ring is disclosed wherein the device facilitates the reversible attachment of various connecting means, such a device having a shoulder connected to a post and such post having at least one aperture running therethrough for attachment of snap hooks, rings etc. Attachment to various desired articles, preferably belts, garments, etc. is accomplished by, e.g., securing the shoulder by adhesive means or through a riveting structure, thereby allowing a post having an aperture therethrough to extend outwardly for easy access by a user. In some embodiments, the attachment device can be loosely attached to a desired article, wherein an attachment of an item via the aperture is sufficient to secure the attachment device to the article.

70 Claims, 5 Drawing Sheets

ATTACHMENT DEVICE FOR KEYS AND OTHER ITEMS

FIELD OF THE INVENTION

The present invention is directed to an attachment device, and more particularly to a device attachable to a belt or garment which facilitates connecting of various devices, including a key chain.

BACKGROUND OF THE INVENTION

Various attachment devices such as key holders and retainers are known in the art, including those described in U.S. Pat. No. 4,072,033 to Eckerdt; U.S. Pat. No. 3,979,934 to Isenmann; U.S. Pat. No. 3,906,763 to Bochory; U.S. Pat. No. 3,771,341 to Laufer; and U.S. Pat. No. 4,004,325 to Hubachek. None of such prior art devices, however, provide a device capable of providing attachment to a desired article (e.g., garment or a belt, or a variety of other items), and that is further constructed of materials, and additionally is of such a design that it facilitates: (1) easy access and secure attachment of, e.g., a key ring or a key chain, and (2) is easily attached and detached from the desired article. There is therefore a long felt but unsolved need for an inexpensive, easy to manufacture attachment device capable of being secured to any number of desired articles, but in particular a garment or a belt, to facilitate the easy, reversible attachment and detachment of a key ring, a key chain or any number of similar items.

SUMMARY OF THE INVENTION

The present invention is directed to a unique, simple and secure attachment device for use as, e.g., a key ring holder (e.g., apparatus 20 of FIG. 1) capable of being installed on a variety of items (denoted "desired articles" herein), including but not limited to clothing, belts, handbags, backpacks and luggage (e.g., a desired article 12 for attachment as in FIG. 1). Additionally, the present invention is directed to the attachment device in combination with a desired article to which the attachment device is attachable and detachable.

In a preferred embodiment, the attachment device (e.g., a key ring holder) of the present invention is constructed from a solid and durable material, such as metal or hardened plastic. A preferred design of the attachment device of the present invention includes an extended post (e.g., post 24 of FIG. 1) connected to a shoulder (e.g., shoulder 22 of FIG. 1), wherein the post includes: (i) a first portion (e.g., post portion 25, FIG. 1) for supportively contacting the attachment device of the invention on the desired article 12, and (ii) an outwardly extending portion (e.g., post portion 27, FIG. 1) having at least one aperture (e.g., aperture 26 of FIG. 1) running therethrough for attaching various other hardware, including clips, snap hooks, quick links, shackles, rings etc (e.g., key chain 13, FIG. 11). The shoulder, in at least some embodiments, includes a first surface (e.g., surface 29 shown in FIGS. 1 through 10) and an opposite second surface (e.g., surface 33 shown in FIGS. 1 and 2). The shoulder is preferably securely mounted to an article (e.g., desired article 12 of FIG. 1 or FIG. 3 when such attachment is desired). In one embodiment, the shoulder is securely fastened to an article which may be a garment, such as jeans, pants, or overalls, thus facilitating easy access to the attachment device of the present invention for a person wearing such a garment. In other embodiments, the attachment device of the present invention can be reversibly attached to desired article (e.g., a garment), such as through a button hole (e.g., button hole 14 of FIG. 3) or other suitable aperture, thus allowing a user to use the attachment device of the present invention with a variety of articles 12 rather than having it securely attached to just one article. The aperture running through the post is preferably of a size to provide for attachment of a variety of connecting apparatuses including but not limited to rings, snap hooks, shackles, etc.

In other embodiments, more than one aperture is provided in the post (e.g., apertures 26 of FIG. 6) to facilitate more than one attaching device passing through said post. Thus, a variety of different key ring attachment means can be reversibly connected by using more than one of such apertures.

In still further embodiments, the post itself has a design to facilitate the reversible secure engagement of a connecting member or item. For example, the post can have an aperture running transversely therethrough which is large enough to extend completely through one wall of the post creating an open side of the post which is closed off by a reversibly and pivotally connected lever member. The preferably spring loaded lever is maintained in a closed position during normal use such that any connecting article must force the pivoting member to move so that the interior of the post aperture can be accessed. The pivoting member can then move back to its normal, closed position, thus securing the connecting article inside the now closed aperture of the post.

Particular embodiments of the present invention are directed to garments having at least one attachment device (e.g., a key ring holder) of the present invention affixed thereto (e.g., overalls 32 of FIG. 11 having apparatus 20 attached thereto). Still other embodiments are directed to belts, preferably made of either plastic, leather or other suitable durable material having at least one attachment device of the present invention attached thereto.

Securement of the attachment device of the present invention to a garment or belt can be achieved in various different ways as will be appreciated by one of skill in the art. Preferably, however, the shoulder (e.g., shoulder 22 of FIG. 1) of the present invention can be attached directly to the garment or belt by a suitable adhesive and/or apertures can be provided in the shoulder for securing the shoulder to a garment or belt with rivets, thread, etc. A still further embodiment involves a rivet connection made possible by the shoulder being of a sufficient diameter such that it will not pass through an aperture in a grommet (e.g., grommet 18 FIG. 1) but which permits the post of the present invention to pass therethrough. To secure the post in such a grommet hole, various means can be employed. For example, the post may be maintained in a desired extended position, facilitating access to the at least one aperture in said post, simply due to the contact with, e.g., a person's body or undergarment pressing outward against the shoulder. Accordingly, the post is loosely slidable along the length of the post between the shoulder and the (nearest) aperture when there is no force against the shoulder for causing contact with the portion of the desired article immediately surrounding the desired article aperture through which the attachment device is attached to the desired article. Thus, when such force is applied, the first shoulder surface (e.g., surface 29 of FIG. 1) contacts a desired article to which the attachment device is attached. Accordingly, an embodiment of the attachment device of the present invention may include a "contact portion" for contacting a desired article and securing the embodiment of the attachment device thereto, wherein, the contact portion includes, e.g., the exterior surface of the shoulder (e.g., surface 29 of FIG. 1), and the first portion (e.g., post portion 25, FIG. 1) described hereinabove. Since the post is loosely slidable within the desired article aperture between the shoulder and the connecting member or item within the aperture, the contact portion of the post for supporting the attachment device on the desired article also can vary along the length of the post between the shoulder and substantially the (nearest) aperture. Accordingly, even the largest extent of the post that is traverse (e.g., perpendicular) to the post's length fits through the desired article aperture. In the embodiments shown in FIGS. 19, an extent of the end of the post that is attached to the shoulder is at least as large as any other extent of the post that is perpendicular to the length of the post.

Alternatively, the attachment device can be more firmly attached inside a grommet hole through the use of an exterior washer (e.g., washer 28, FIGS. 10 and 11) that fits over the post once the post has extended through the grommet hole. Thus, the shoulder is of sufficient circumference and diameter so that it cannot pass through a grommet hole, but wherein the post may extend through the hole, whereby a washer is placed over the post to secure it in place. One will appreciate that the washer placed over the post may be of different configurations, colors, etc. and is primarily intended as a cosmetic component. The washer may not require a fixation to the post and/or fabric adjacent thereto and can simply be maintained in its position on the post due to the fact that an attaching ring or article through the post aperture will prevent the washer from falling off. The washer can, however, also be affixed to the grommet structure and/or the belt, fabric, etc. of the desired article to which the grommet is attached. Various adhesives, riveting structures, threaded connections, etc., are also possible in order to achieve securement of the attachment device of the present invention to a desired article.

In use, a person threads a connecting device, such as a snap hook or a circular, overlapping wire ring, through the at least one aperture provided in the post. Once attached, the connecting device will simply hang from the post, thus facilitating the carrying of key chains, key rings, and various other desired hardware.

The size, diameter and circumference of the aperture provided in the post can obviously vary depending upon the particular use intended. Preferably, the aperture is at least about 1 centimeter in diameter, more preferably at least about ⅛th of an inch, and most preferably over about ¼ of an inch. The size of the aperture can be varied to accommodate the attachment of various hardware, such as the girth of snap hooks or rings that maybe used in conjunction with the attachment device of the present invention.

The length of the post can similarly be varied depending upon the particular uses to which the attachment device of the present invention is directed. The preferred length of the post is at least about 1 cm, more preferably at least about ¼ inch and most preferably at least about ½ inch. The length should not, however exceed about one inch unless more than one aperture is provided therethrough. For example, if more than one aperture is provided in the post, the post can be of a longer length than if merely one aperture were afforded therein. Indeed, in one embodiment, several apertures are provided in a post to facilitate the attachment of more than one connecting means. Thus, different numbers and sizes of apertures may also be provided in a post to facilitate particular uses.

The aperture through the post is preferably perpendicular to the length of the post, but can, in various embodiments, be in any angular orientation through the transverse section of the post. In a preferred embodiment, the aperture is a double counter sunk hole (see FIG. 1) so as to facilitate the easy attachment and detachment of a connecting means. Moreover, the shape of the aperture can be of any desired geometry, but is preferably round. Thus, octangular, triangular, square and other shaped holes are within the scope of the present invention.

The extent of the shoulder diameter (in a circular shoulder embodiment) can be of any size sufficient to anchor the present invention in an article to which it is attached. Preferably, the diameter of the shoulder is slightly less than the length of the post. As one of skill will appreciate, the particular geometrical configuration of the shoulder can vary, but in a preferred embodiment, it is circular in shape. Other geometries that are preferred lack sharp edges which could negatively affect articles to which the present invention is attached given that the weight of any connecting means on the post will create pivotal torsion on the edges of the shoulder against the garment, belt, or other article to which the attachment device of the present invention is attached, thus causing undesired abrasion.

In some embodiments, reinforcement of a garment or other desired article to which the attachment device of the present invention is attached maybe necessary in order to insure proper and long term attachment of the shoulder to the garment, belt or other article. For example, with respect to a garment, a suitable additional patch material maybe provided that provides additional tensile strength to the garment fabric surrounding and attaching to the shoulder region of the attachment device of the present invention.

Still a further embodiment of the present invention is directed to an embodiment where the shoulder has a transverse aperture provided therein to facilitate slipping the shoulder (22) over an existing button (30) of a garment (12), such as a metal button common on denim jeans. For example, traverse aperture 34 of FIG. 4 is representative, wherein this aperture has a first interior side 35 for contacting the hidden side of the button 30, and an opposing second interior side, interior to the shoulder, for contacting the button side 31. Accordingly by slipping the present device (20) over an existing button 30, easy attachment of the present attachment device to a desired article is made possible without the need to provide a separate hole in the desired article (e.g., jeans or other articles), and without the need to provide adhesives, separate rivets, etc. Thus, an embodiment of the attachment device of the present invention may include a "contact portion" for contacting, e.g., a button, of a desired article and securing the embodiment thereto, wherein, the contact portion includes the first and second interior surfaces of the shoulder described hereinabove.

In a preferred embodiment, the post and the shoulder are fixedly attached to each other, and indeed, in a most preferred embodiment, they are made integral with one another. Other embodiments, however include a threaded connection between the post and shoulder (FIG. 9), a ball and socket connection (FIG. 8), a snap-lock connection (not shown) etc. Again, while the attachment device of the present invention can be comprised of plastic or metal, in a preferred embodiment, the attachment device of the present invention is made from a metal material, such as brass, steel, nickel etc. or other metal alloys. Accordingly, in at least some embodiments, both the shoulder 22 and the post 24 are rigid. As illustrated in the accompanying FIGS. 2, 5, 6, 7 and 8, the shoulder 22 and post 24 are fixedly attached to one another separately from any attachment to a desired article such as a garment, jeans, pants, overalls, belt, purse, handbag, backpack, luggage etc. Since, in at least some embodiments of the attachment device, the shoulder and post are integral with one another, the shoulder 22 and the post 24 can not be separated from one another without damaging the attachment device so that it can no longer, without unintended repair effort not described herein, be used to perform at least one function for which the attachment device is designed and described herein. At least for the embodiments of the attachment device that have a shoulder and post that are integral, the shoulder and post are also fixedly attached to each other throughout the process of affixing the attachment device of the present invention to the desired article.

As shown in each of the embodiments of FIGS. 1–3 and 5–10, to assure that such embodiments can be reversibly attached (i.e., attached and detached) to one or more desired articles, the post 24 does not include an extent that is expanded in a direction traverse to its length such that such an expanded extent would prevent moving the post along its length between its connection to the shoulder and the opposite end of the post that is not attached to the shoulder.

Although in a preferred embodiment the post is connected to the shoulder at a 90° angle, other angular orientations are well within the scope of the present invention. Indeed, FIG. 7, shows one embodiment of the attachment device of the present invention where the post is angled downwardly to limit the degree of extension of the post away from a belt or garment to which it is attached.

Other features and embodiments will be revealed to those of skill in the art from a review of the detailed description of preferred embodiments and the figures described and featured herein.

DETAILED DESCRIPTION OF THE INVENTION

Figure 1:
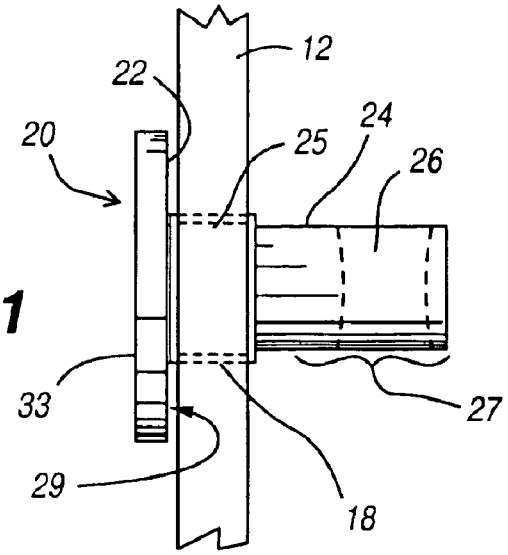
FIG. 1 is a side view of the present invention (e.g., apparatus 20 and/or the desired article 12) showing one view of the aperture (26) running through the post (24), wherein the post (24) has a uniform cross section along its length between the shoulder (22) and at least the aperture (26)
Figure 2:
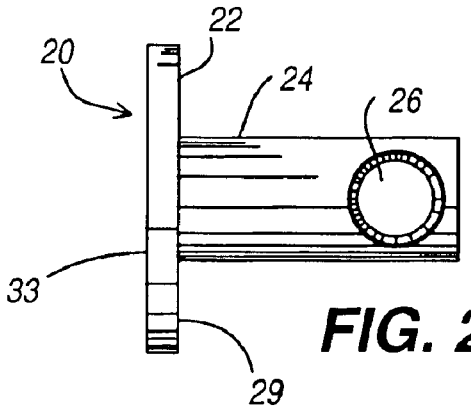
FIG. 2 is a side view of the attachment device of the present invention turned 90° from that shown in FIG. 1.
Figure 3:
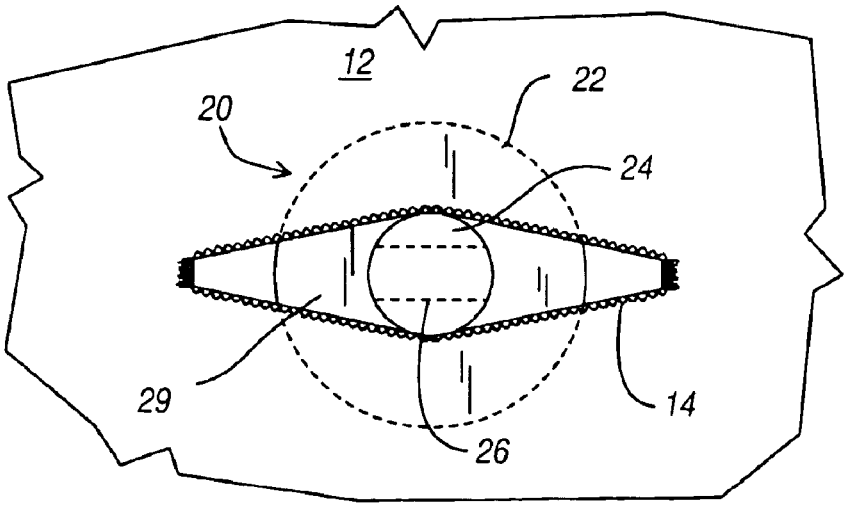
FIG. 3 is a top view of the present invention showing the smaller diameter of the post (24) as compared to the larger diameter of the surrounding shoulder (22)
Figure 4:
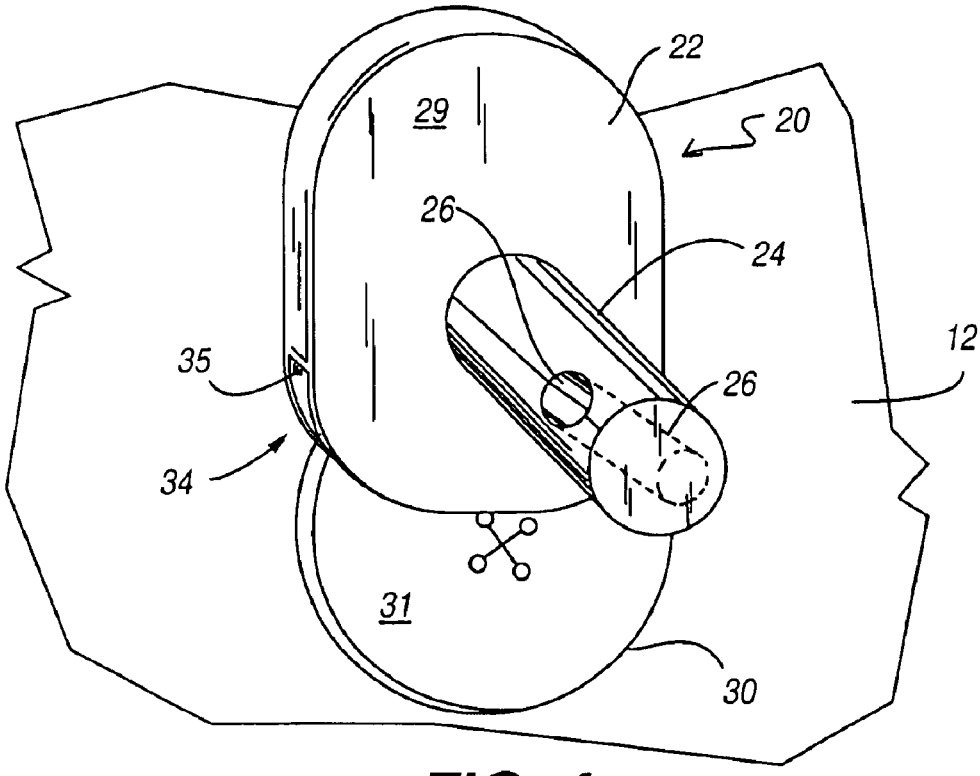
FIG. 4 is an alternative embodiment of the present invention wherein the shoulder (22) facilitates slipping over a button (30) existing on a garment (12)
Figure 5:
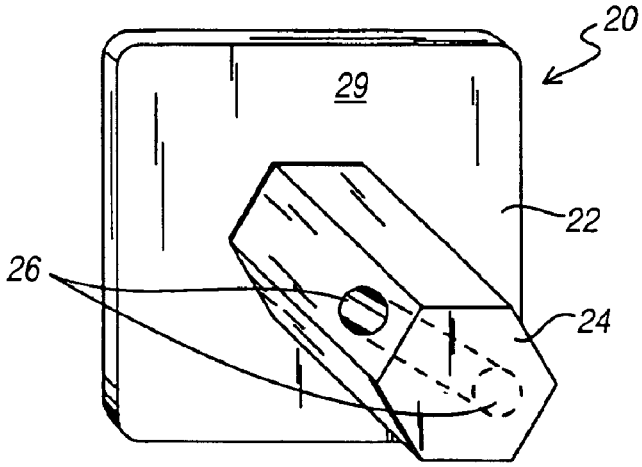
FIG. 5 illustrates another embodiment to the attachment device of the present invention where the shoulder (22) and aperture (26) through the post (24) are of a distinct geometrical configuration, and in particular, the post (24) has a uniform cross section along its length between the shoulder (22) and the post's end that is opposite the post end attached to the shoulder, more particularly, the post (24) has a polygonal cross section.

Referring to FIGS. 1–11, the present invention, wherein attachment device 20 comprises a shoulder 22 connected to a post 24, such post having at least aperture 26 running transversely therethrough. In a preferred embodiment, the aperture 26 is a double counter sunk hole as shown in FIG. 1. The diameter of the shoulder 22 is preferably less than the length of the post 24 but can be of any particular size in order to facilitate secure attachment of the key ring holder to a desired article, such as a garment, belt, purse, etc.

Figure 6:
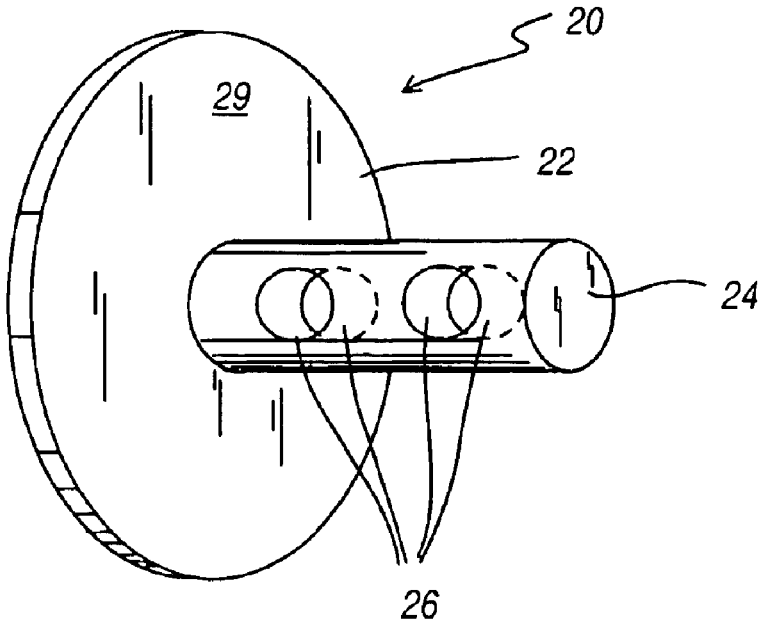
FIG. 6 illustrates another embodiment of the attachment device of the present invention having more than one aperture (26) through the post (24)
Figure 7:
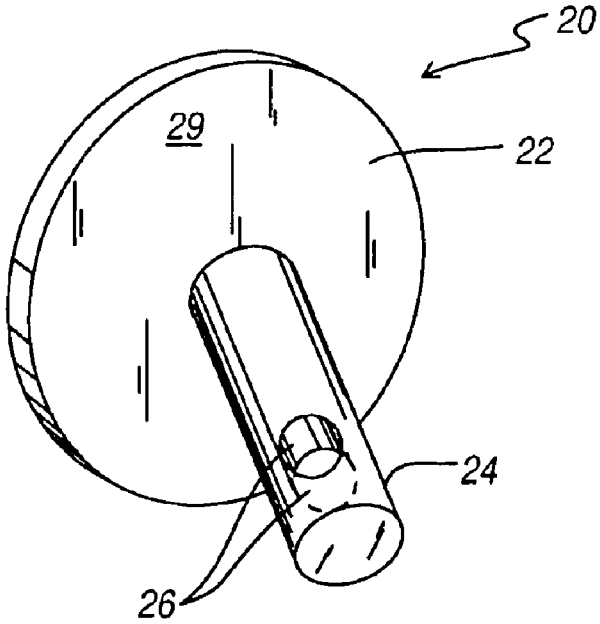
FIG. 7 illustrates one embodiment of the attachment device of the present invention where the post (24) is angularly connected to the shoulder (22), wherein the post (24) has a uniform cross section along its length between the shoulder (22) and at least the aperture (26), and in particular, the post 24 is substantially a cylinder.
Figure 8:
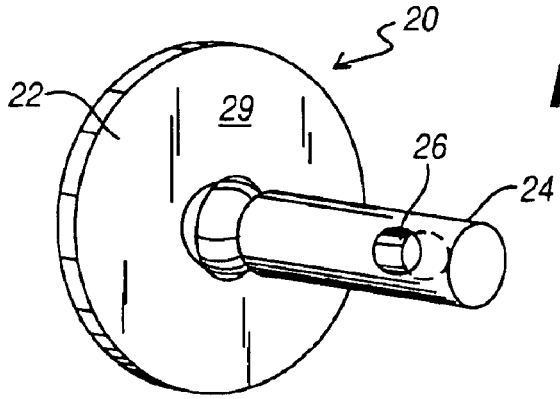
FIG. 8 shows a ball and socket connection between the shoulder (22) and the post (24)

FIG. 6, shows one embodiment of the attachment device of the present invention having more than one aperture 26 provided through the post 24. FIG. 7 shows the aperture 26 being provided at a slanted angle through the post 24.

Figure 9:
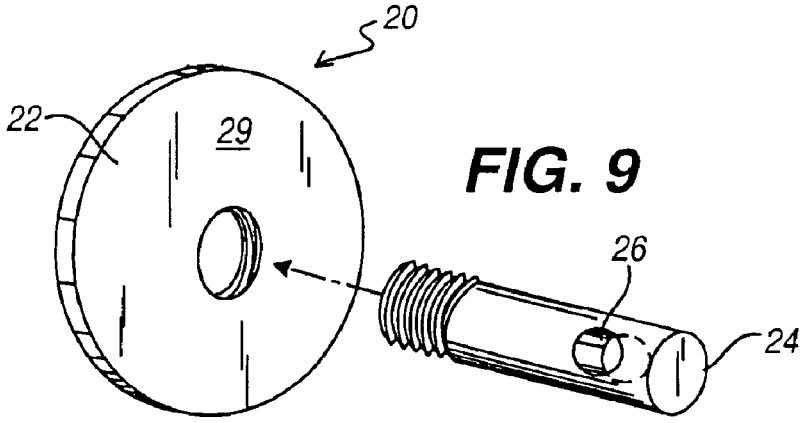
FIG. 9 shows a threaded connection between the post (24) and the shoulder (22)

FIG. 9, shows one embodiment where the post 24 is threadedly engageable with the shoulder 22, thus facilitating removal of the post 24 from the shoulder 22.

Figure 10:
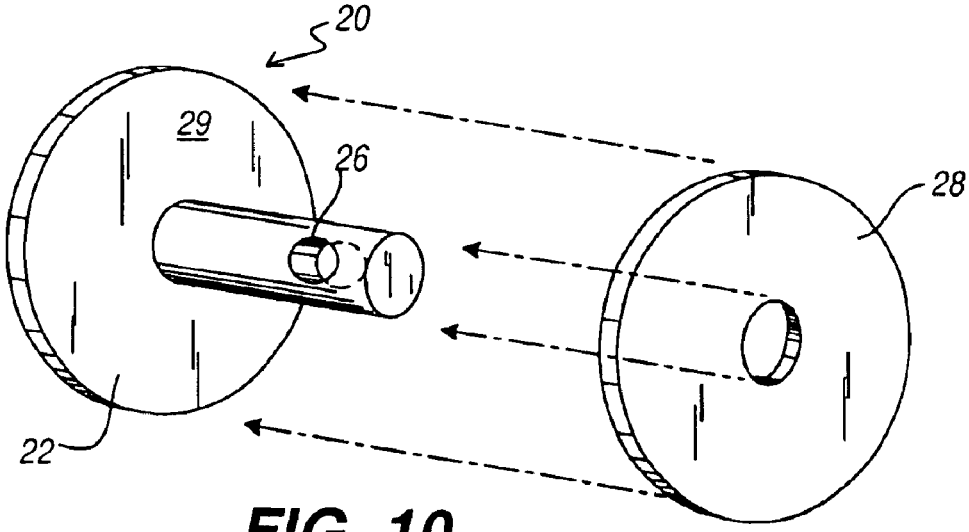
FIG. 10 shows one embodiment of the present invention wherein a washer (28) is fit over the post (24) for securement purposes.

FIG. 10, shows one embodiment wherein the post 24 has a washer 28 which fits over the post.

Figure 11:
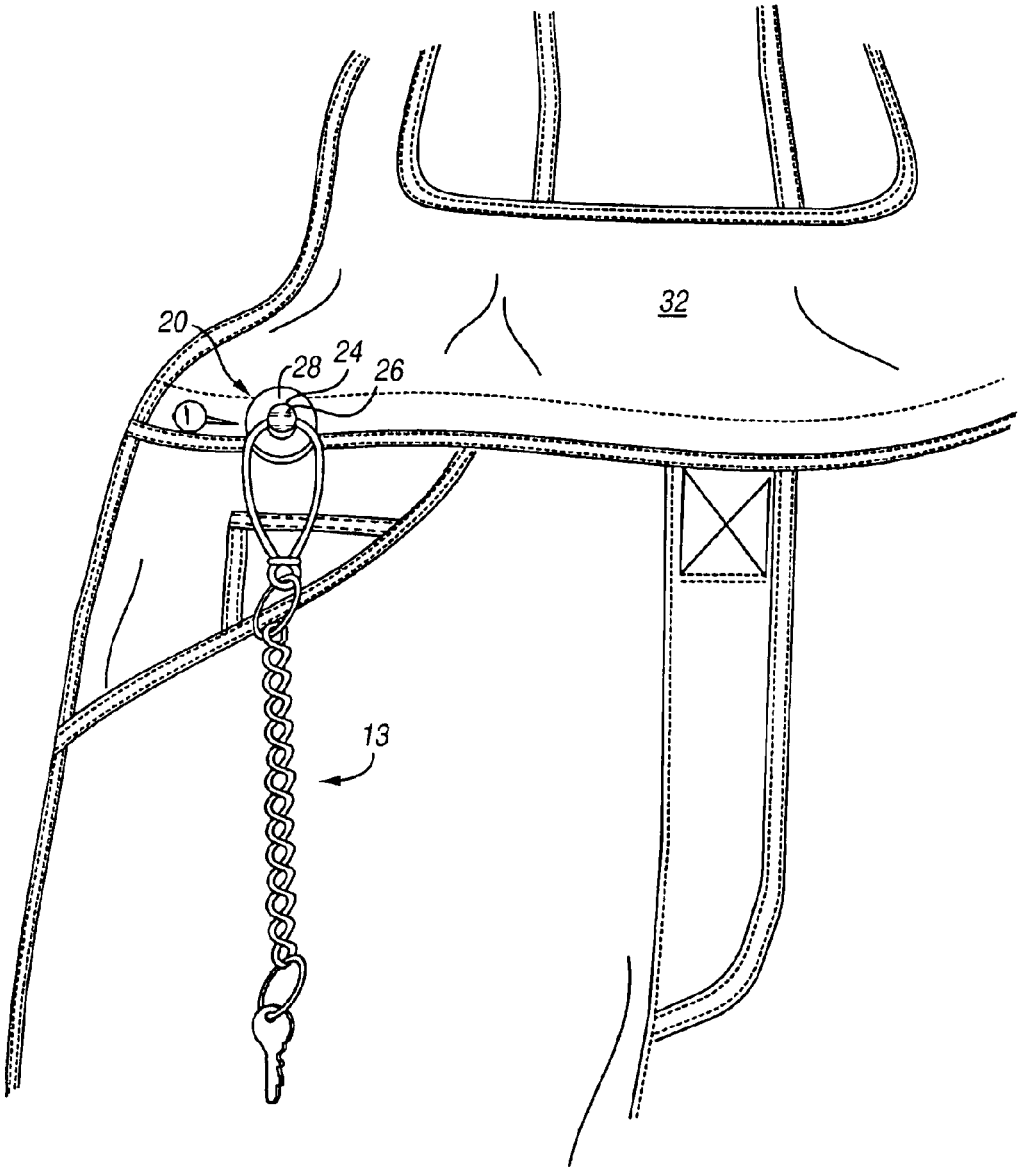
FIG. 11 shows the present invention as it is used on jeans with a key ring/chain (13).

FIG. 11, shows the present invention (e.g., including the embodiment of FIG. 10) as it may be used on jeans with a key ring/chain 13. The post 24 is fed through a hole in a garment, belt, etc.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A device affixed to a desired article, and for attaching one or more items to said device, comprising, an extended post having a length extending between first and second ends of said extended post, and at least one aperture running transversely therethrough said length;

said extended post operatively connected to a shoulder at said first end, whereby said shoulder includes:

(i) an interior side facing toward an interior volume defined substantially by said desired article, said interior volume adapted for placing one or more body portions or objects therein;

(ii) an exterior side facing substantially away from the interior volume; and (iii) an extent of the shoulder traverse to said length that is effective for preventing said shoulder from extending through an opening in said desired article;

wherein said extended post extends through the opening so that an outwardly extending portion of said extended post extends outwardly from said exterior side, and said outwardly extending portion includes said aperture, and wherein the opening has an enclosed perimeter of said desired article that fully closes about said extended post;

wherein at least said shoulder and said first end of said extended post are attached to each other prior to said device being affixed to the desired article, wherein said first end has a traverse extent to said length, said traverse extent of the first end is at least as large as any other post extent that is perpendicular to said length;

wherein said shoulder and said first end remain attached to each other throughout an affixing of said device to the desired article;

wherein said extended post includes a first portion within the opening, said first portion connecting between at least a portion of said shoulder and said outwardly extending portion, for providing support to said device on said desired article, wherein a user of said device can attach different items to said device by inserting, for each of said different items, a corresponding attachment in said aperture provided in said outwardly extending portion; and wherein one or both of:

(1) said desired article includes one of: jeans, a pair of pants, and an overall; and (2) said extended post extends through a fabric when said device is attached to the desired article.

2. The device as set forth in claim 1 further comprising a washer that fits over said extended post and is slidable between said desired article and said second end, wherein said washer is for assisting in securing said device to said desired article.

3. The device of claim 1 wherein said extended post and said shoulder are threadedly connected to each other.

4. The device as set forth in claim 1 wherein said extended post has only one aperture therethrough.

5. The device as set forth in claim 1 wherein said at least one aperture is a double counter sunk hole.

6. The device as set forth in claim 1 wherein said extended post and said shoulder are connected to each other at a 90 degree angle.

7. The device as set forth in claim 1 wherein said extended post and said shoulder are connected to each other with a ball and socket connection.

8. The device as set forth in claim 1, wherein an entirety of said extended post, and said shoulder are continuously fixedly attached to each other prior to said device being affixed to said desired article, throughout an affixing of said device to said desired article, and independently of whether said device is affixed to said desired article or not.

9. A device affixed to a desired article, and for attaching one or more items to said device, wherein the desired article has:

(i) an interior side facing toward an interior volume defined substantially by said desired article, said interior volume adapted for placing one or more body portions or objects therein; and (ii) an exterior side facing substantially away from the interior volume, comprising:

an extended post having a length extending between first and second ends of said extended post, and at least one aperture running transversely of said length;

a shoulder having first and second surfaces, and fixedly attached to said extended post substantially at said first end, wherein said extended post includes a portion that extends outwardly from at least said first surface and said aperture is on said outwardly extending portion of said extended post;

wherein at least (1) an entirety of said extended post from said first end to approximately said aperture, and (2) said shoulder are attached to each other prior to and throughout said device being affixed to the desired article;

a contact portion for contacting the desired article for thereby supporting said device on said desired article, said contact portion including at least part of said shoulder for contacting said desired article when said device is supported on said desired article;

wherein a user can reversibly attach different items to said device by inserting, for each of said different items, a corresponding attachment in said aperture;

wherein said desired article supports said device by requiring one or both of:

(a) said contact portion includes a portion of said length extending through an opening from a portion of the interior side to a portion of the exterior side further from said interior volume, wherein said desired article supports said device, regardless of an orientation of said desired article about said length, and wherein said extended post does not include an extent that is expanded in a direction traverse to said length wherein such an expanded extent substantially prevents movement of said opening along said length from said shoulder to substantially said aperture; and (b) said contact portion includes opposing interior sides of said shoulder, wherein said interior sides are between said first and second surfaces and substantially define an enclosure for contacting a front and back of a button of said desired article so that the device is supported on the desired article by the button, wherein said first and second sides face away from one another; and wherein said desired article includes one of: a garment, a belt, a purse, an item of luggage, a backpack, jeans, a pair of pants, and an overall.

10. The device of claim 9, wherein said contact portion includes a portion of said length extending through said desired article wherein said desired article supports said device regardless of an orientation of said desired article about said length.

11. The device of claim 9, wherein removal of said extended post from said shoulder damages said device.

12. The device of claim 1, wherein said article includes a flexible portion that is adapted to conform to the user's body.

13. The device of claim 1, wherein said desired article includes at least one extent that is greater than a largest extent of said shoulder.

14. The device of claim 1, wherein said first portion includes an extent of said extended post extending through said desired article such that said device is supported on said desired article independently of an orientation of said extent of said extended post relative to said desired article.

15. The device of claim 1, wherein the desired article includes one of; jeans, a pair of pants, and an overall.

16. The device of claim 1, wherein said first portion is used to support said device on said desired article.

17. The device of claim 9, wherein said desired article is portable with the user and includes at least a portion which conforms to a part of the user's body contacting said desired article.

18. The device of claim 9, wherein said interior sides are spaced apart an effective amount for allowing the button to slide therebetween and thereby support the device on the desired article.

19. The device of claim 1, wherein said extended post is rigid with said aperture being in a fixed orientation relative to said shoulder.

20. The device of claim 1, wherein said desired article includes a pair of jeans.

21. The device of claim 1, wherein said device further includes a washer provided on said extended post between said first portion and said aperture, wherein said washer is slidable between said desired article and said second end.

22. The device of claim 9, wherein said portion of said length has a washer provided thereon, said washer between the desired article and said aperture, wherein said washer is not integral with said extended post so that said device can be detached from the desired article by removing said washer and said attachment from said extended post, and wherein said washer is slidable between said desired article and said second end.

23. The device of claim 9, wherein there is no component between said shoulder and said aperture for providing a clamping pressure for securing said device to the desired article.

24. The device of claim 1, wherein said extended post extends through the opening provided in the fabric when said device is attached to the desired article.

25. The device of claim 1, wherein said extended post supports said device on said desired article independently of what portion of said length, between said shoulder and said aperture, contacts the desired article.

26. The device of claim 1, wherein said extended post includes an entire exterior shape that does not prevent said device from being removed from the opening by sliding said extended post in a direction from said shoulder towards the second end.

27. The device of claim 26, wherein said entire exterior shape has, throughout the length between said aperture and said shoulder, a substantially uniform cross sectional shape.

28. The device of claim 27, wherein said entire exterior shape is, throughout the length between said aperture and said shoulder, a cylinder.

29. The device of claim 26, wherein said entire exterior shape has, throughout the length polygonal cross section.

30. The device of claim 26, wherein when at least one corresponding attachment is engaged with said aperture, said at least one corresponding attachment has at least one extent that extends in a direction traverse to said length, wherein said at least one extent is larger than a uniform cross sectional shape of the extended post in the same direction.

31. The device of claim 1, wherein said extended post loosely engages, along said length, said opening for supporting the device on the desired article.

32. The device of claim 9, wherein (a) is required.

33. The device of claim 9, wherein (b) is required.

34. The device of claim 9, wherein the extended post is rigid throughout its length.

35. The device of claim 9, wherein (a) holds and said shoulder has an extent of the shoulder traverse to said length that is effective for preventing said shoulder from extending through said opening, and said device does not include an extent along said length between said shoulder and substantially said aperture that prevents movement of said device along said length.

36. The device of claim 9, wherein said extended post and shoulder are fixedly attached to each other when either one of said extended post and shoulder are affixed to the desired article.

37. The device of claim 9, wherein said extended post and shoulder are fixedly attached to each other throughout a process of removal of the device from the desired article.

38. The device of claim 37, wherein after the removal of said device from said desired article, said extended post and shoulder are fixedly attached to each other for being affixed back to the desired article by substantially only reinserting said extended post into the opening and reattaching an item in said aperture.

39. The device of claim 37, wherein said extended post and shoulder are fixedly attached to each other during an attachment of the device to an additional desired article once said device is removed from the desired article, wherein the additional desired article is included in one of the following categories that is different from a category that includes the desired article, said categories being: garments, belts, luggage, purses, backpacks, and luggage.

40. The device of claim 9, wherein said shoulder has at least one extent of the shoulder traverse to said length that is greater than an adjacent extent of said opening, and for an entire extent of said device between said shoulder and said second end, said device fits within said opening for sliding therethrough.

41. A method for attaching one or more items to a desired article, comprising:

providing a device to attach to the desired article, wherein said desired article has:

(i) an interior side facing toward an interior volume defined substantially by said desired article, said interior volume adapted for placing one or more body portions or objects therein, (ii) an exterior side facing substantially away from the interior volume, and (iii) an article hole from the interior side to the exterior side;

wherein said device includes:

(a) an extended post having a length with first and second ends terminating said length, and said extended post having at least one post aperture running transversely through said length; and (b) a shoulder operatively connected to said extended post at said first end, wherein said shoulder has an extent traverse to the length that does not fit through the article hole;

wherein said extended post includes an outwardly extending portion extending along said length, said outwardly extending portion including at least an entire extent of said extended post: (1) from, and including, said post aperture, and (2) to said second end, wherein an entire exterior of said outwardly extending portion fits through the hole;

wherein said extended post also includes a first portion extending between at least a portion of said shoulder and said outwardly extending portion, for providing support to said device on said desired article when a step of fitting said outwardly extending portion through said hole is performed;

attaching at least one item through said post aperture, said item restricting a disengagement of said device from the desired article; and removing said device from said desired article by removing said at least one item from said post aperture;

attaching said device to an additional desired article once said device is removed from the desired article, wherein the additional desired article is included in one of the following categories that is different from a category that includes the desired article, said categories being: clothing belts, luggage, purses, backpacks, and luggage; and fitting said outwardly extending portion through a hole in said additional desired article is performed.

42. The method of claim 41, further including supporting said device on said desired article independently of what portion of said length, between said shoulder and said aperture, contacts the desired article.

43. The method of claim 41, wherein said step of removing includes sliding said extended post in a direction from said shoulder towards the second end.

44. The method of claim 41, wherein said step of attaching includes engaging the at least one item, wherein the at least one item has at least one extent in a direction traverse to said length, wherein said at least one extent is larger than the opening in the same direction.

45. The method of claim 41, wherein said extended post loosely engages, along said length, said opening for supporting the device on the desired article.

46. The method of claim 41, wherein the extended post is rigid throughout its length.

47. The method of claim 41, wherein said shoulder has an extent traverse to said length that is effective for preventing said shoulder from extending through said opening, and said device does not include an extent along said length between said shoulder and substantially said aperture that prevents movement of said device along said length.

48. The method of claim 41, wherein said extended post and shoulder are fixedly attached to each other throughout said step of fitting.

49. The method of claim 41, wherein said step of removing includes detaching said extended post and shoulder as a single unit from said desired article.

50. The device of claim 41, a further step, after said removing step, of reattaching said device to said desired article, wherein said extended post and shoulder are reattached as a single unit to the desired article by substantially only performing a step of reinserting said extended post into the opening and reattaching an item in said aperture.

51. The method of claim 41, wherein said shoulder has at least one extent traverse to said length that is greater than an adjacent extent of said opening, and for an entire extent of said device between said shoulder and said second end, said device fits within said opening for sliding therethrough.

52. An apparatus having a desired article and an attachment device for attaching and detaching one or more items to the desired article, comprising:

a desired article having (1) and (2)

(1) an interior side facing toward an interior volume defined substantially by said desired article, said interior volume adapted for placing one or more body portions or objects therein, and (2) an exterior side facing substantially away from the interior volume;

an attachment device for attaching one or more items to said desired article, wherein said attachment device includes (3) through (5)

(3) an extended post having a length extending between first and second ends of said extended post;

(4) at least one aperture running transversely of said length, wherein a user can reversibly attach different items to said attachment device by inserting, for each of said different items, a corresponding attaching component attachment in said aperture; and (5) a shoulder having first and second surfaces, wherein said first and second sides face away from one another, wherein said first surface is attached to said extended post substantially at said first end, and said extended post extends outwardly from said first surface, and said aperture is on an outwardly extending portion of said extended post that extends away from said first surface;

wherein said desired article supports said attachment device regardless of an orientation of said desired article about said length;

wherein said desired article supports said attachment device by requiring one or both of (8) and (9) to hold:

(8) a portion of said length extends through a hole from a portion of the interior side to a portion of the exterior side further away from said interior volume than the portion of the interior side, and said extended post does not include an extent that is expanded in a direction traverse to said length wherein such an expanded extent substantially prevents movement of said hole extended post along said length from said shoulder to said second end, and wherein said shoulder has an extent traverse to said length that is effective for preventing said shoulder from extending through said hole; and (9) said shoulder includes opposing interior sides, wherein said interior sides are strictly between said first and second surfaces, wherein said interior side substantially define an enclosure for contacting a front and back of a button of said desired article so that the attachment device is supported on the desired article by the button; and wherein said desired article includes one of: an item of clothing, a belt, a purse, a backpack, and an item of luggage.

53. The apparatus of claim 52, wherein said shoulder and said extended post are fixedly attached to one another and can not be separated without damaging said attachment device.

54. The apparatus of claim 52, wherein said shoulder and said extended post are attached to one another via a ball and socket connection.

55. The apparatus of claim 52, wherein said shoulder and said extended post are attached to one another by said first end being threadably received in mating threads of said shoulder.

56. The apparatus of claim 52, wherein (8) holds, and said attachment device is removed from said desired article by moving said attachment device in a direction relative to said desired article so that said hole disengages from said extended post.

57. The apparatus of claim 52, wherein (8) holds, and said attachment device is removable from said desired article, wherein after removal of said attachment device, said attachment device is reattachable to said desired article by reinsertion into said hole.

58. The apparatus of claim 52, wherein said shoulder and said extended post remain attached to one another throughout an affixing of said attachment device to said desired article.

59. The apparatus of claim 52, wherein said extended post loosely engages, along said length, said hole for supporting said attachment device on said desired article.

60. The apparatus of claim 52, wherein said extended post and said shoulder are detached from said desired article as a single unit.

61. The apparatus of claim 52, wherein said shoulder and a largest extent of said extended post traverse to said length are attached to each other prior to said attachment device being affixed to the desired article, and said extended post and shoulder remain attached to each other independently of said attachment device being affixed to the desired article or not.

62. The apparatus of claim 52, wherein at least said shoulder and said first end of said extended post are attached to each other prior to said attachment device being affixed to the desired article, wherein said first end has a traverse extent to said length, said traverse extent of the first end is at least as large as any other post extent that is perpendicular to said length, and wherein said shoulder and said traverse extent remain attached independently of whether said attachment device is affixed to said desired article or not.

63. The device of claim 1, wherein said extended post does not include an extent that is expanded in a direction traverse to said length such that said expanded extent prevents movement of the opening along said length, from said shoulder to substantially said second end.

64. The device as set forth in claim 1, wherein an entirety of said extended post from at least said first end to said at least one traverse extent are fixedly attached to each other both prior to said device being affixed to said desired article, and throughout an affixing of said device to said desired article.

65. An apparatus having a desired article and an attachment device for attaching and detaching one or more items to the desired article, comprising:

a desired article having:

(1) an interior side facing toward an interior volume defined substantially by said desired article, said interior volume adapted for placing one or more body portions or objects therein; and (2) an exterior side facing substantially away from the interior volume;

(3) an opening in said desired article, wherein said opening has an enclosed perimeter of said desired article;

an extended post having a length extending between first and second ends of said extended post, and at least one aperture running transversely therethrough said length;

said extended post operatively connected to a shoulder at substantially said first end, whereby said shoulder includes (i) through (iii) following:

(i) an interior side facing toward an interior volume defined substantially by said desired article, said interior volume adapted for placing one or more body portions or objects therein;

(ii) an exterior side facing substantially away from the interior volume, wherein said shoulder is positioned on said interior side; and (iii) an extent traverse to said length that is effective for preventing said shoulder from extending through said opening;

wherein said extended post extends through said opening so that said perimeter closes about said extended post, wherein an outwardly extending portion of said extended post extends outwardly from said exterior side, and said outwardly extending portion includes said aperture;

wherein there is no component between said shoulder and said aperture for providing a clamping pressure for securing said device, in a fixed position, to the desired article;

wherein said extended post includes a first portion within the opening, said first portion connecting between at least a portion of said shoulder and said outwardly extending portion, for providing support to said device on said desired article, wherein a user of said device can attach different items to said device by inserting, for each of said different items, a corresponding attachment in said aperture provided in said outwardly extending portion; and wherein said desired article includes one of: an item of clothing, a belt, a purse, a backpack, and an item of luggage.

66. A device affixed to a desired article, and for attaching one or more items to said device, comprising, an extended post having a length extending between first and second ends of said extended post, and at least one aperture running transversely therethrough said length;

said extended post operatively connected to a shoulder at said first end, whereby said shoulder includes:

(i) an interior side facing toward an interior volume defined substantially by said desired article, said interior volume adapted for placing one or more body portions or objects therein;

(ii) an exterior side facing substantially away from the interior volume, wherein said shoulder is positioned on said interior side, and said extended post extends through an opening in said desired article so that an outwardly extending portion of said extended post extends outwardly from said exterior side, and said outwardly extending portion includes said aperture, and wherein said opening has an enclosed perimeter of said desired article that closes about said extended post; and (iii) an extent traverse to said length that is effective for preventing said shoulder from extending through said opening;

wherein prior to said device being affixed to the desired article, at least (a) said shoulder; and (b) at least one traverse extent of said extended post, are attached to each other;

wherein said at least one traverse extent is substantially perpendicular to said length such that said at least one traverse extent is at least as large as any other post extent that is perpendicular to said length;

wherein said shoulder and said traverse extent remain attached to each other throughout an affixing of said device to the desired article;

wherein said extended post includes a first portion within the opening, said first portion connecting between at least a portion of said shoulder and said outwardly extending portion, for providing support to said device on said desired article, wherein a user of said device can attach different items to said device by inserting, for each of said different items, a corresponding attachment in said aperture provided in said outwardly extending portion; and wherein said desired article includes one of: an item of clothing, a belt, a purse, a backpack, and an item of luggage.

67. A device to be affixed to a desired article, and for attaching one or more items to said device, comprising, an extended post having a length extending between first and second ends of said extended post, and at least one aperture running transversely therethrough said length;

said extended post operatively connected to a shoulder at said first end, whereby said shoulder includes:

(i) an interior side facing toward an interior volume defined substantially by said desired article, said interior volume adapted for placing one or more body portions or objects therein;

(ii) an exterior side facing substantially away from the interior volume; and (iii) an extent of the shoulder traverse to said length that is effective for preventing said shoulder from extending through an opening in said desired article;

wherein said extended post extends through the opening so that an outwardly extending portion of said extended post extends outwardly from said exterior side, and said outwardly extending portion includes said aperture, and wherein the opening has an enclosed perimeter of said desired article that fully closes about said extended post;

wherein at least said shoulder and said first end of said extended post are attached to each other prior to said device being affixed to the desired article, wherein said first end has a traverse extent to said length, said traverse extent of the first end is at least as large as any other post extent that is perpendicular to said length;

wherein said shoulder and said first end remain attached to each other throughout an affixing of said device to the desired article;

wherein said extended post includes a first portion within the opening, said first portion connecting between at least a portion of said shoulder and said outwardly extending portion, for providing support to said device on said desired article, wherein a user of said device can attach different items to said device by inserting, for each of said different items, a corresponding attachment in said aperture provided in said outwardly extending portion; and a washer that fits over said extended post and is slidable between said desired article and said second end, wherein said washer is for assisting in securing said device to said desired article.

68. A device affixed to a desired article, and for attaching one or more items to said device, wherein the desired article has:

(i) an interior side facing toward an interior volume defined substantially by said desired article, said interior volume adapted for placing one or more body portions or objects therein; and (ii) an exterior side facing substantially away from the interior volume, comprising:

an extended post having a length extending between first and second ends of said extended post, and at least one aperture running transversely of said length;

a shoulder having first and second surfaces, and fixedly attached to said extended post substantially at said first end, wherein said extended post includes a portion that extends outwardly from at least said first surface and said aperture is on said outwardly extending portion of said extended post;

wherein at least (1) an entirety of said extended post from said first end to approximately said aperture, and (2) said shoulder are attached to each other prior to and throughout said device being affixed to the desired article;

a contact portion for contacting the desired article for thereby supporting said device on said desired article, said contact portion including at least part of said shoulder for contacting said desired article when said device is supported on said desired article;

wherein a user can reversibly attach different items to said device by inserting, for each of said different items, a corresponding attachment in said aperture;

wherein said desired article supports said device by requiring one or both of:

(a) said contact portion includes a portion of said length extending through an opening from a portion of the interior side to a portion of the exterior side further from said interior volume, wherein said desired article supports said device, regardless of an orientation of said desired article about said length, and wherein said extended post does not include an extent that is expanded in a direction traverse to said length wherein such an expanded extent substantially prevents movement of said opening along said length from said shoulder to substantially said aperture; and (b) said contact portion includes opposing interior sides of said shoulder, wherein said interior sides are between said first and second surfaces and substantially define an enclosure for contacting a front and back of a button of said desired article so that the device is supported on the desired article by the button, wherein said first and second sides face away from one another; and wherein said extended post and shoulder are fixedly attached to each other throughout a process of removal of the device from the desired article, and said extended post and shoulder are fixedly attached to each other during an attachment of the device to an additional desired article once said device is removed from the desired article, wherein the additional desired article is included in one of the following categories that is different from a category that includes the desired article, said categories being: garments, belts, luggage, purses, backpacks, and luggage.

69. A device to be affixed to a desired article, and for attaching one or more items to said device, wherein the desired article has:

(i) an interior side facing toward an interior volume defined substantially by said desired article, said interior volume adapted for placing one or more body portions or objects therein; and (ii) an exterior side facing substantially away from the interior volume, comprising:

an extended post having a length extending between first and second ends of said extended post, and at least one aperture running transversely of said length;

a shoulder having first and second surfaces, and fixedly attached to said extended post substantially at said first end, wherein said extended post includes a portion that extends outwardly from at least said first surface and said aperture is on said outwardly extending portion of said extended post;

wherein at least (1) an entirety of said extended post from said first end to approximately said aperture, and (2) said shoulder are attached to each other prior to and throughout said device being affixed to the desired article;

a contact portion for contacting the desired article for thereby supporting said device on said desired article, said contact portion including at least part of said shoulder for contacting said desired article when said device is supported on said desired article;

wherein a user can reversibly attach different items to said device by inserting, for each of said different items, a corresponding attachment in said aperture;

wherein said desired article supports said device by requiring said contact portion to include includes opposing interior sides of said shoulder, wherein said interior sides are between said first and second surfaces and substantially define an enclosure for contacting a front and back of a button of said desired article so that the device is supported on the desired article by the button, wherein said first and second sides face away from one another; and wherein said interior sides are spaced apart an effective amount for allowing the button to slide therebetween and thereby support the device on the desired article.

70. A device to be affixed to a desired article, and for attaching one or more items to said device, wherein the desired article has:

(i) an interior side facing toward an interior volume defined substantially by said desired article, said interior volume adapted for placing one or more body portions or objects therein; and (ii) an exterior side facing substantially away from the interior volume, comprising:

an extended post having a length extending between first and second ends of said extended post, and at least one aperture running transversely of said length;

a shoulder having first and second surfaces, and fixedly attached to said extended post substantially at said first end, wherein said extended post includes a portion that extends outwardly from at least said first surface and said aperture is on said outwardly extending portion of said extended post;

wherein at least (1) an entirety of said extended post from said first end to approximately said aperture, and (2) said shoulder are attached to each other prior to and throughout said device being affixed to the desired article;

a contact portion for contacting the desired article for thereby supporting said device on said desired article, said contact portion including at least part of said shoulder for contacting said desired article when said device is supported on said desired article;

wherein a user can reversibly attach different items to said device by inserting, for each of said different items, a corresponding attachment in said aperture;

wherein said desired article supports said device by requiring said contact portion to include opposing interior sides of said shoulder, wherein said interior sides are between said first and second surfaces and substantially define an enclosure for contacting a front and back of a button of said desired article so that the device is supported on the desired article by the button, wherein said first and second sides face away from one another.

* * * * *